United States Patent [19]

Myers

[11] Patent Number: 4,733,991

[45] Date of Patent: Mar. 29, 1988

[54] ADJUSTABLE RISER TOP JOINT AND METHOD OF USE

[75] Inventor: Roderick J. Myers, Houston, Tex.

[73] Assignee: Conoco Inc., Ponca City, Okla.

[21] Appl. No.: 936,579

[22] Filed: Dec. 1, 1986

[51] Int. Cl.[4] ..... E02D 21/00; B63B 35/44; E21B 7/128

[52] U.S. Cl. ..... 405/195; 405/224; 114/264; 166/367; 175/7

[58] Field of Search ..... 405/195–198, 405/202, 224, 303; 166/350, 359, 367; 175/5–7; 114/264, 265

[56] References Cited

U.S. PATENT DOCUMENTS

| | | | |
|---|---|---|---|
| 3,981,369 | 9/1976 | Bokenkamp | 175/5 |
| 3,983,706 | 10/1976 | Kalinowski | 405/224 |
| 4,198,179 | 4/1980 | Pease et al. | 166/359 X |
| 4,226,555 | 10/1980 | Bourne et al. | 405/224 |
| 4,364,323 | 12/1982 | Stevenson | 114/265 |
| 4,379,657 | 4/1983 | Widiner et al. | 405/303 X |
| 4,395,160 | 7/1983 | deJong | 405/195 |
| 4,420,276 | 12/1983 | Roberts | 405/224 |
| 4,423,983 | 1/1984 | Dadiras et al. | 405/195 |
| 4,505,614 | 3/1985 | Anschutz | 405/195 |

*Primary Examiner*—Nancy J. Stodola
*Attorney, Agent, or Firm*—Richard K. Thomson

[57] ABSTRACT

An adjustable riser top joint for connecting an offshore subsurface well to a deck mounted welltree. A first plurality of generally annular protrusions on the riser top joint section affords a plurality of connecting points for the wellhead tree using either a unitary or a split collar type attachment. A second plurality of protrusions positioned below deck afford a second plurality of connecting points for riser tensioning means that may also, preferably, be attached using either a unitary or a split collar. The generally annular protrusions are formed as a continuous spiral groove on an external surface of the riser section in a first preferred embodiment and as a series of generally cylindrical protrusions of equal length and spacing in a second preferred embodiment.

14 Claims, 5 Drawing Figures

ADJUSTABLE RISER TOP JOINT AND METHOD OF USE

BACKGROUND AND SUMMARY OF THE INVENTION

The present invention relates to a method and apparatus for connecting a well on the ocean floor with a wellhead "Christmas" tree, (i.e., the flow control valves) on a fixed or relatively fixed platform, such as a floating tension leg platform, or the like. More particularly, the present invention relates to a riser top joint used in completing such a connection that makes it unnecessary to precisely measure the distance between the well and the wellhead tree.

One of the benefits of a tension leg platform over other floating systems is the very small vertical oscillation that occurs. This enables the wellhead trees to be mounted within a few feet of a platform deck without the need for some complex form of motion compensation system. However, the use of a rigid riser system requires a precise measurement between the well on the ocean floor and the deck of the platform, in order to obtain a riser of the necessary length. Such precise measurement becomes increasingly difficult as the water depth moves from hundreds to thousands of feet deep.

It is an object of the present invention to make such an accurate measurement unnecessary. By providing a riser top joint that affords continuous or stepwise adjustability, the requirement of precision measurement between the well and the tree is obviated. The riser top joint of the present invention comprises a generally cylindrical pipe having a first internal diameter and a first outer diameter. A series of equally spaced generally annular protrusions extend outwardly from said first outer diameter to a second outer diameter providing a series of connection points. The protrusions extending above the upper surface of the deck of the platform comprise a first series of connection points for the wellhead tree that may be secured thereto by means of either a unitary or a split segmented collar. The protrusions extending below the lower surface of the deck comprise a second series of connection points for a riser tensioner to maintain essentially uniform tension on the riser despite the small vertical motion of the platform resulting from the wave-induced pendulum-like motion of the platform. The generally annular protrusions may most preferably take the form of a continuous spiral groove on the external surface of the riser permitting continuous adjustability.

The method of using the variable riser top joint in accordance with the present invention involves making up the riser string with the top joint of the invention, positioning the top joint such that the generally cylindrical protrusions extend both above the top surface and below the bottom surface of the well deck, cutting off any excess riser joint, securing a collar about said top joint at a point spaced from the top end thereof, attaching a wellhead tree to the top of said riser joint and packing off said wellhead tree.

Various other features, advantages and characteristics of the present invention will become apparent after a reading of the following specifications.

DETAILED DESCRIPTION OF THE PREFERRED EMBODIMENTS

Figure 1:
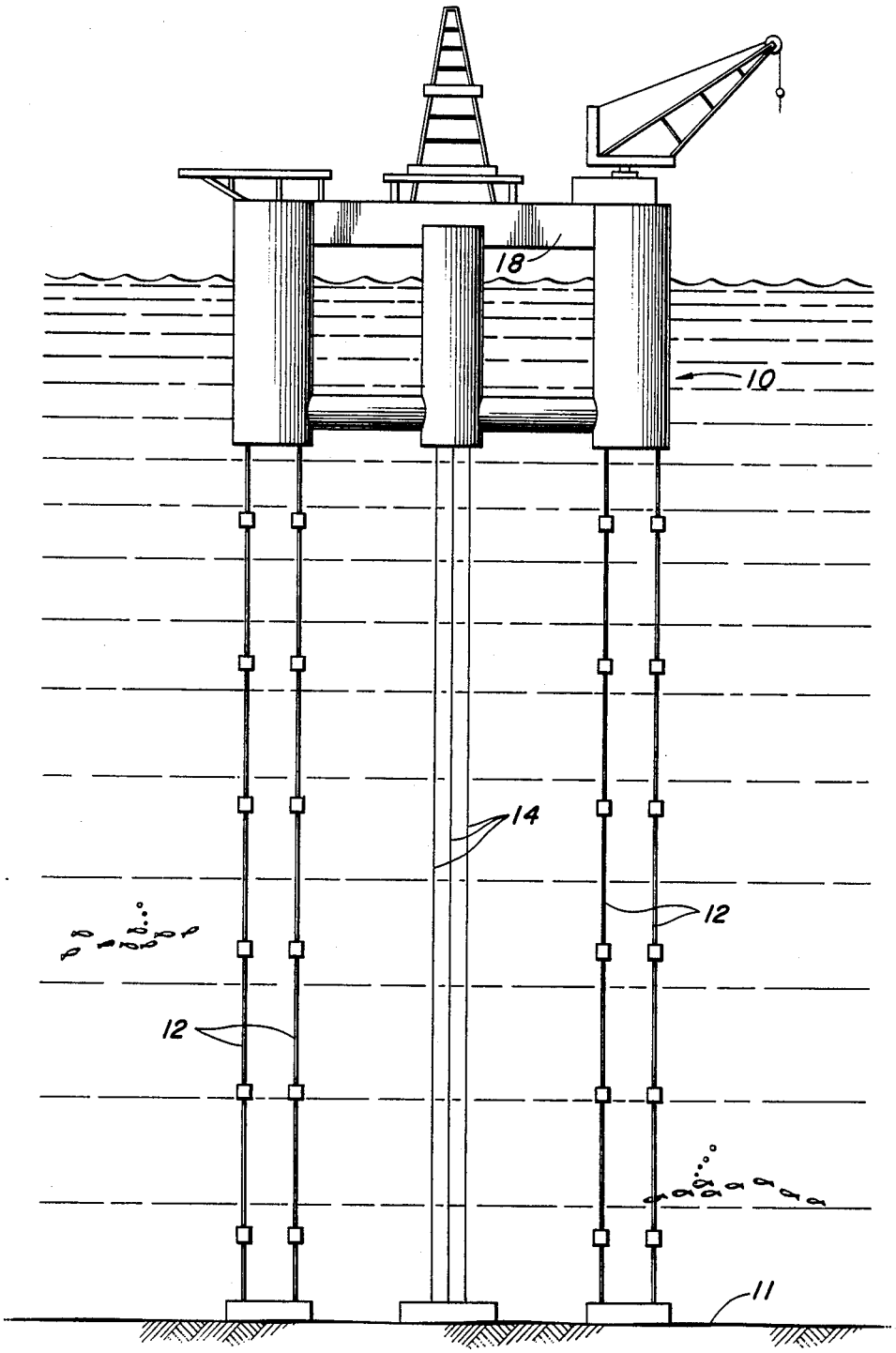
FIG. 1 is a schematic elevational view of a tension leg platform secured in position with production risers connected thereto.

A tension leg platform is shown in FIG. 1 generally at 10. While the adjustable riser top joint of the present invention is peculiarly designed for use with a tension leg platform, it will be appreciated that such a top joint might be utilized with other fixed and relatively fixed (i.e., floating systems with minimal vertical motion) platforms, as well.

Figure 2:
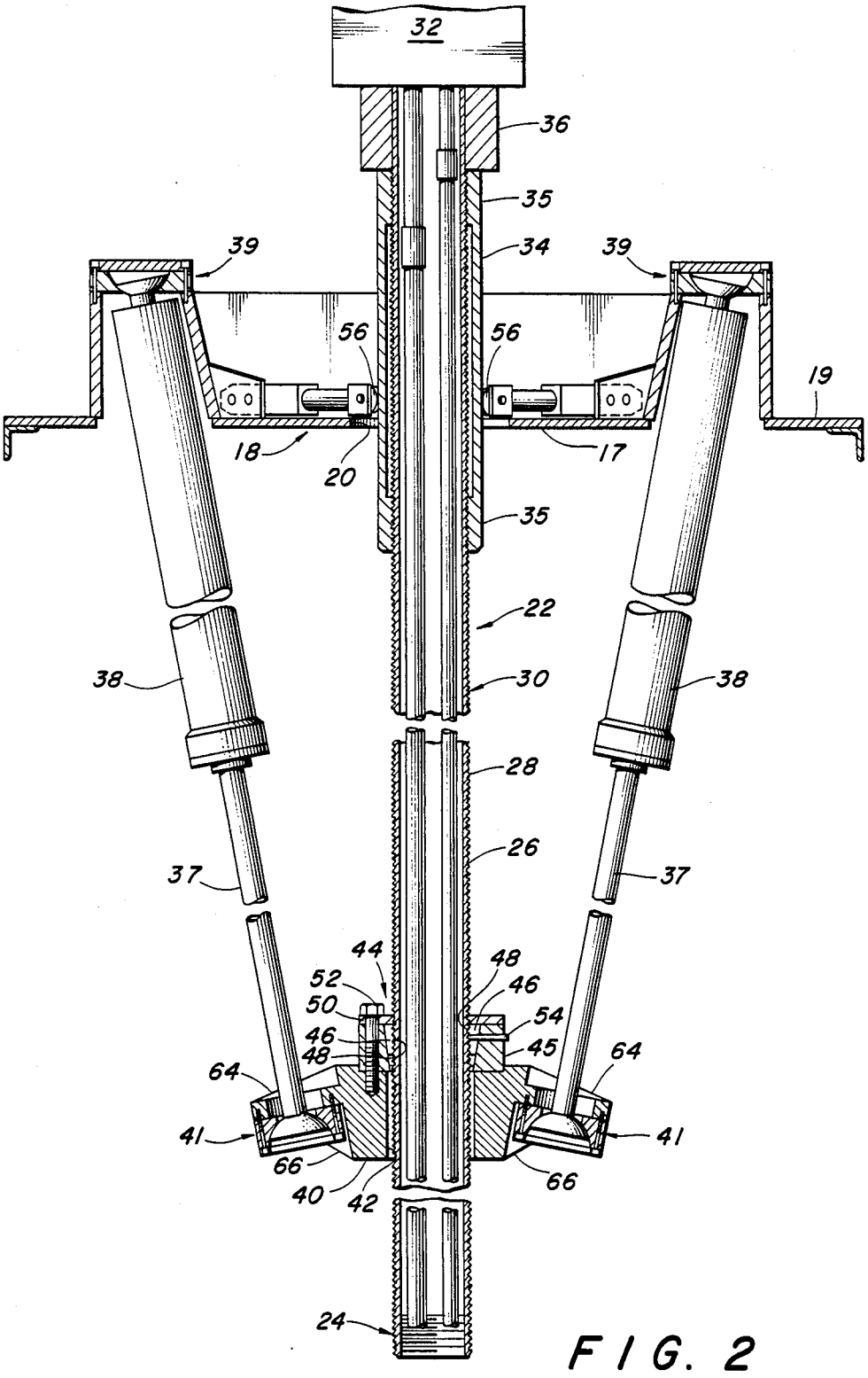
FIG. 2 is a schematic side view of a first preferred embodiment of the riser top joint of the present invention showing its usage with a tension leg platform.

Platform 10 is secured to the ocean floor 11 by a plurality of tendons 12. A plurality of risers 14 extend between the individual wells in template 16 and a wellhead deck 18 of platform 10. As seen in FIG. 2, riser 14 extends through a hole 20 in deck 18 that permits some relative motion between the deck 18 and riser 14 that occurs as a result of wave action on the platform 10.

The riser top joint of the present invention is depicted in FIG. 2 generally at 22. Lower end 24 is internally threaded to connect with standard riser joint in a conventional manner. Note, although a straight-walled thread is depicted, a tapered thread may be used if desired. The internal diameter of section 22 is to be the same as any other riser section in the particular string 14. The first outer diameter 26 will match that of the remainder of the riser. However, a second outer diameter is formed by a plurality of generally annular protrusions 28 that are generally equally spaced. In the embodiment shown in FIG. 2, generally cylindrical protrusions 28 are formed by a continuous helical groove 30 formed on the outer surface of riser top joint 22.

Figure 3:
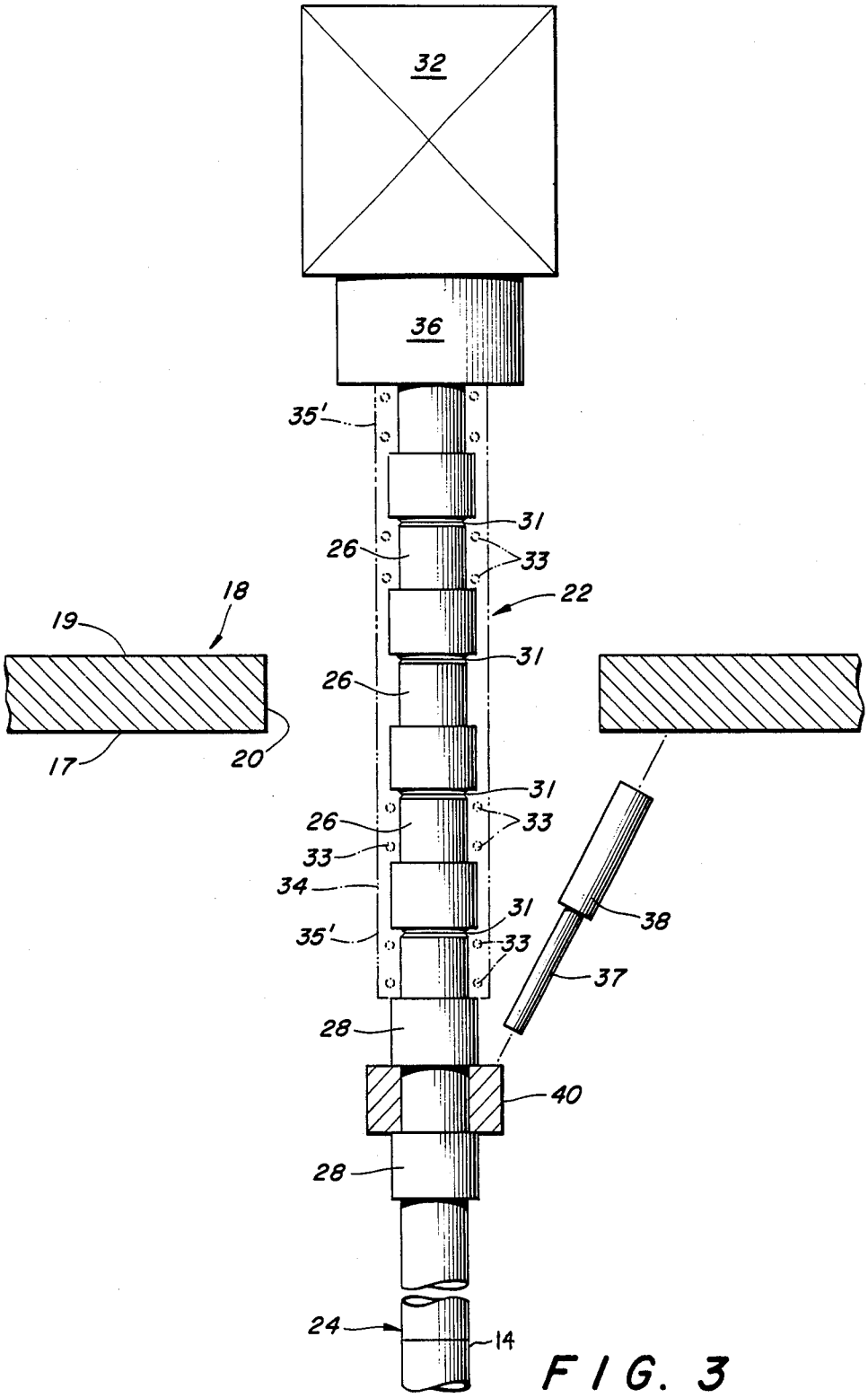
FIG. 3 is a schematic side view of a second preferred embodiment of the riser top joint of the present invention.

In the embodiment depicted in FIG. 3, generally annular protrusions 28 are formed as cylindrical protrusions of a specified length and particular spacing. These design characteristics (length and spacing) will be selected in accordance with the particular needs of the application such as tensioner load parameters, accuracy of water depth measurement, etc. In this embodiment, the surface of the riser may be scored on diameter 26 as at 31 adjacent the bottom of each protrusion 28 for reasons to become apparent hereinafter.

In both the FIG. 2 and the FIG. 3 embodiments, top joint 22 extends through hole 20 in such a manner that a first plurality of annular protrusions 28 extend above the top surface 19 of deck 18 while a second plurality extend below the bottom surface 17 of the deck 18. The first plurality of protrusions 28 serve as a plurality of connection points for well tree 32. Well tree 32 may be attached at any of the potential connection points by cutting off excess length of the riser guided initially by a thread groove or by the appropriate score line 31, installing either a unitary or a split segmented collar 34 at a position spaced from the top end of the riser top joint, attaching well tree 32 to the top end of joint 22 and positioning packoff 36 upon collar 34. With respect to the utilization of the embodiment employing helical groove 30, the top 4 to 8 turns of the groove will be machined off after the riser joint has been cut to length so packoff 36 will have a smooth surface to engage.

Figure 5:
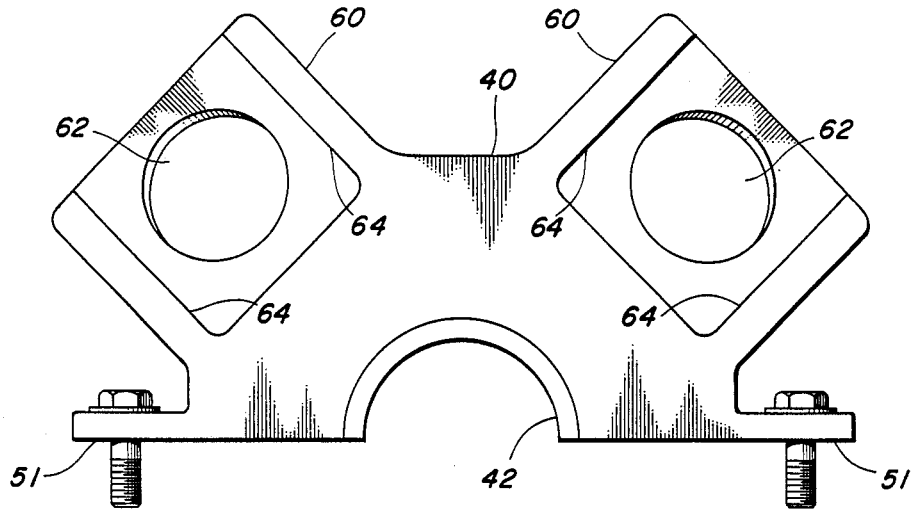
FIG. 5 is a top view of one segment of the split segmented riser tensioner ring used with the FIG. 3 embodiment.
Figure 4:
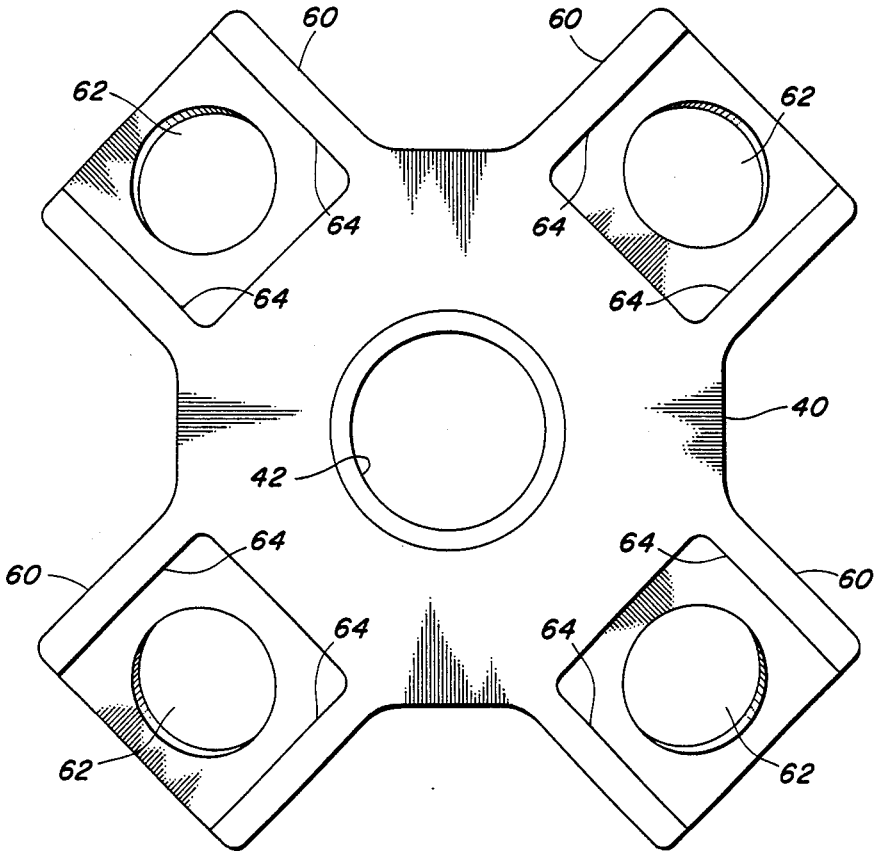
FIG. 4 is a top view of the unitary tensioner ring used with the FIG. 2 embodiment.

The second plurality of protrusions 28 below the lower surface 17 of the deck 18 provide a series of connection points for a second unitary or split collar tensioner ring 40 which in turn, is a connector for a series of riser tensioners 38. While any type of riser tensioner may be used, riser tensioners 38 are preferably of the pneumatic-hydraulic variety described and claimed in U.S. Pat. No. 4,379,657, which is hereby incorporated by reference. Note, however, the paired cylinder concept employed within said patent has been made unnecessary by angling the riser tensioners 38 and, hence the action lines for the load forces so that those lines pass through the center line of the riser eliminating torsional loading. The unitary designed collar 40 shown in FIG. 4 is preferably used with the FIG. 2 embodiment while the split segmented collar design of FIG. 5 is more appropriate with the FIG. 3 configuration. The configuration of the riser tensioners 38, collar 40 and deck 20 of the FIG. 3 embodiment are substantially identical to the FIG. 2 device and, accordingly have been shown schematically, depicting only the differences between the two embodiments.

The unitary design tensioner ring 40 shown in FIGS. 2 and 4 has a throughbore 42 of sufficient diameter to clear the outer diameter of spiral groove 30. A conventional slip mechanism 44 comprised of camming ring 45, wedges 46 with internally arcuate, threaded surfaces 48 and a clamping plate 50, is bolted to tensioner ring 40 by a plurality (one shown) of securing bolts 52. Camming ring 45 forces wedges 46 into engagement with spiral groove 30 and clamping plate 50 holds the wedges 46 in engaged position. A lateral pin 54 can be utilized to prevent relative rotation between camming ring 45 and wedges 46 and, hence, between tensioner ring 40 and top joint 22. The split segment tensioner ring 40 of the FIG. 3 embodiment is shown in FIG. 5. The details of the configuration are similar with this alternate design being formed with two flanges 51 to permit the segments to be bolted together. The inner diameter of opening 42 conforms generally to base diameter 26 of riser top joint 22 to facilitate its connection to the stepwise variable top joint embodiment of FIG. 3.

Lateral stabilizing rollers 56 engage the external surface of collar 34 to keep the riser 14 centered within opening 20. In the FIG. 2 embodiment only a short portion 35 at each end of collar 34 is full thickness (i.e., has a minimum internal diameter) and is threaded to engage the spiral groove 30 of top joint 22. In the FIG. 3 embodiment, sections 35 are full thickness to fill in the spaces between annular protrusions 28 and one section of split segment collar 34 is tapped as at 33 to receive connecting bolts (not shown) countersunk in the other split segment. This provides a smooth external surface for stabilizing rollers 56 to engage and facilitates their operation.

The four riser tensioners 38 (two shown) are interconnected to the platform deck 18 by a modified ball-and-socket joint 39 that permits some rotational movement between the tensioners 38 and deck 18 that will occur as the arms 37 of tenisoners 38 extend and retract to maintain a uniform tension on riser 14. A similar modified ball-and-socket connection 41 is used to connect the ends of arms 37 to tensioner ring 40 to permit the same rotational motion between tensioners 38 and tensioner ring 40. It will, of course, be appreciated that any number of riser tensioners may be used.

The riser top joint 22 of the present invention obviates the need for a precise measurement between the well 42 on the ocean floor and the upper surface 19 of deck 18. The top joint 22 may merely be connected to the top of riser 14 to extend through hole 20 in deck 18 with pluralities of protrusions above and below deck 18 to provide attachment points. The top of the riser joint 22 and the production tubing contained therein may then be cut to length and the well tree 32 and riser tensioners 38 installed using unitary or split segmented collars 34 and 40 respectively. The FIG. 2 embodiment provides significant flexibility since thread 30 provides continuous adjustment capability. Riser tensioners 38, acting through means of tensioner ring 40, provide a continuous upward tension on riser 14 despite relative movement of platform deck 18. This eliminates the threat of buckling, crimping or otherwise damaging the riser 14. Both the continuously adjustable riser top joint of the FIG. 2 embodiment and the stepwise adjustable embodiment of FIG. 3 increase the tolerance in measuring the distance between the ocean floor and the intended position of the well tree thereby facilitating installation by providing a plurality of acceptable installation positions. In addition, each of the embodiments provides a second plurality of acceptable connecting points for a riser tensioner ring.

Various changes, alternatives and modifications will become apparent following a reading of the foregoing specification. Accordingly, it is intended that all such changes, alternatives and modifications as come within the scope of the appended claims be considered part of the present invention.

I claim:

1. A riser section for use as a top joint of a production riser to adjustably position a wellhead tree in a fixed location relative to a well on an ocean floor while permitting relative movement between said fixed well-head tree and a deck of a floating platform or the like above which said wellhead tree is mounted, said deck having an upper surface and a lower surface, said riser section comprising:

a generally cylindrical pipe length having a first internal diameter and a first external diameter;

a series of generally annular protrusions that are generally equally spaced from one another and extend outwardly from said first external diameter;

said series of annular protrusions extending through an opening in the deck of said platform both above said upper surface and below said lower surface thereby affording a first plurality of connection points for said wellhead tree above the upper surface of said deck and a second plurality of connection points for riser tensioner means below the lower surface of said deck such that the deck of said platform may move relative to said fixed wellhead tree.

2. The riser section of claim 1 wherein the generally annular protrusions are formed by a continuous spiral groove on an external surface of said riser section permitting continuous adjustability of said wellhead tree and said riser tensioner means with respect thereto.

3. The riser section of claim 2 further comprising a unitary collar for attaching said wellhead tree to said riser section at one of said first plurality of said connection points by threadably engaging said continuous spiral groove.

4. The riser section of claim 2 wherein said riser tensioner means comprises a unitary collar for attaching said riser tensioner means to said riser section at one of said second plurality of connection points by threadably engaging said continuous spiral groove.

5. The riser section of claim 1 wherein the generally annular protrusions are formed as a series of cylindrical protrusions of uniform length.

6. The riser section of claim 5 further comprising a split segmented collar for attaching said wellhead tree to said riser section at one of said first plurality of connection points.

7. The riser section of claim 6 wherein said riser tensioner means comprises a split segmented collar to facilitate its attachment to said riser section at one of said second plurality of connection points.

8. The riser section of claim 1 further comprising a collar for attaching said wellhead tree to said riser section at one of said first plurality of connection points.

9. The riser section of claim 1 wherein said riser tensioner means further comprises a collar for attachment to said riser section at one of said second plurality of connection points.

10. The riser section of claim 9 wherein said riser tensioner means further comprises a plurality of hydraulic-pneumatic actuators connected to said platform deck and to said riser tensioner collar.

11. The riser section of claim 1 wherein said riser tensioner means comprises a plurality of hydraulic-pneumatic actuators.

12. The riser section of claim 1 wherein each of said annular protrusions extends an equal distance outwardly from said first external diameter to a second external diameter.

13. A method of installing a wellhead tree above a deck of a platform, said method comprising:

inserting an adjustable riser section as a top joint of a producing riser, said riser section having a plurality of connecting points for attaching a wellhead tree, said riser section traversing an opening in the deck of said platform and extending above an upper surface and below a lower surface of said deck for substantial distances;

cutting off said adjustable section at one of said plurality of said connecting points above said upper surface of said deck as desired;

securing a first collar to said adjustable section at a point spaced from said cut off end, said collar functioning as a means of attaching said wellhead tree;

attaching said wellhead tree and a packoff assembly to the top of said production riser above said first collar.

14. The method of claim 13 further comprising securing a second collar to said adjustable riser section at a suitable point below the lower surface of said deck, and attaching riser tensioning means to said lower surface of said deck and to said second split collar.

* * * * *